US007273239B1

(12) United States Patent
Hauber

(10) Patent No.: US 7,273,239 B1
(45) Date of Patent: Sep. 25, 2007

(54) LATCH FOR SLIDING CLOSURES

(75) Inventor: Peter Hauber, Buellton, CA (US)

(73) Assignee: Builder's Hardware, Buellton, CA (US)

( * ) Notice: Subject to any disclaimer, the term of this patent is extended or adjusted under 35 U.S.C. 154(b) by 122 days.

(21) Appl. No.: 10/839,820

(22) Filed: May 5, 2004

Related U.S. Application Data

(60) Provisional application No. 60/468,506, filed on May 6, 2003.

(51) Int. Cl.
*E05C 1/12* (2006.01)

(52) U.S. Cl. ..... 292/165; 292/173

(58) Field of Classification Search ..... 292/163, 292/165, 167, 170, 169, 173, DIG. 46
See application file for complete search history.

(56) References Cited

U.S. PATENT DOCUMENTS

| | | | | |
|---|---|---|---|---|
| 2,749,167 | A * | 6/1956 | Love | 292/226 |
| 2,758,862 | A * | 8/1956 | Endter | 292/165 |
| 4,231,597 | A * | 11/1980 | Pelcin | 292/164 |
| 5,292,159 | A * | 3/1994 | Sandhu et al. | 292/173 |
| 5,484,178 | A * | 1/1996 | Sandhu et al. | 292/173 |
| 2002/0163205 | A1* | 11/2002 | Sekulovic | 292/163 |

* cited by examiner

*Primary Examiner*—Gary Estremsky
(74) *Attorney, Agent, or Firm*—Goodwin Procter LLP

(57) ABSTRACT

Latch assembly of a keeper structure and a latch structure has a frame a frame recess, a guide pin received in said frame recess for oscillating rotation, the guide pin having a handle tab for rotating the guide pin and a dog projecting from said guide pin. A latch tongue is slidably mounted in a latch tongue guide and has a tongue dog cooperating structure for advancing and retracting the latch tongue responsive to rotation of the dog on the guide pin. The guide pin is spring biased to project the latch tongue toward the latch structure. The dog cooperating structure and dog are relatively proportioned to permit rearward movement of the latch tongue without commensurately moving the handle tab upon displacing engagement of the keeper structure and the latch tongue but to move the handle tab and latch tongue together in forward movement of the latch tongue into keeper structure latching engagement. The latch assembly can further have a keeper structure and a latch structure including latch tongue and handle and guide pin carried cooperating dogs. The latch tongue dogs and the guide pin dogs are relatively proportioned to permit rearward movement of the latch tongue without commensurately moving the handle upon displacing engagement of the keeper structure and the latch tongue but to move the handle and latch tongue together in forward movement of latch tongue into keeper structure latching engagement. A secondary latch assembly selectively blocks handle movement in the locked condition of the primary latch assembly.

18 Claims, 5 Drawing Sheets

LATCH FOR SLIDING CLOSURES

RELATED APPLICATION

This application claims the benefit of U.S. Provisional Application Ser. No. 60/468,506 filed May 6, 2003.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to latch closures for sliding panels of windows and doors. More particularly, the invention relates to latches having handle-actuators that do not shift upon closing of the window or door, so that fingers are not pinched, but readily actuate to open the latch.

2. Description of the Related Art

A variety of latches for sliding windows and doors are known. To my knowledge the existing types of latches for sliders of the window or door type, do not achieve in a low cost construction the benefits of non-shifting of the latch actuator upon closing of the closure panel to the frame, nor do existing designs avoid pinching of fingers in the latch handle upon slamming closure.

BRIEF SUMMARY OF THE INVENTION

The invention provides a latch for sliding closure panels that is immediately positive in its unlocking operation, but slips in its closing operation to let the latch actuator remain substantially in place while the latch tongue and keeper lock the moving panel to the stationary panel.

More particularly, the invention provides a latch assembly comprising a keeper structure and opposed thereto a latch structure, the latch structure comprising a frame having a longitudinal frame axis, a semicylindrical frame recess in the frame generally parallel with the frame axis, a guide pin received in the frame recess for oscillating rotation, the guide pin having a handle tab for rotating the guide pin and a dog projecting from the guide pin at an angle to the handle tab, a latch tongue guide formed on the frame, a latch tongue slidably mounted in the latch tongue guide, the latch tongue having dog cooperating structure for advancing and retracting the latch tongue responsive to rotation of the dog on the guide pin, the guide pin being spring biased to project the latch tongue toward the latch structure, the dog cooperating structure and dog being relatively proportioned to permit rearward movement of the latch tongue without commensurately moving the handle tab upon displacing engagement of the keeper structure and the latch tongue but to move the handle tab and the latch tongue together in forward movement of the latch tongue into keeper structure latching engagement.

In this and like embodiments, typically, the frame comprises transverse bosses defining the latch tongue guide, the guide pin has terminal slots, and there is included biasing springs kept in the slots for resiliently rotating the guide pin and dog, there is also a housing cooperating with the frame to enclose the guide pin and dog, the latch tongue dog cooperating structure comprises an angled slot having a front wall normal to the latch tongue plane of movement and a rear wall sloped away from the front wall in dog engagement differentiated relation for forward and rearward movement, and the keeper structure comprises a base to be fixed to a wall, and a keeper tongue, the keeper tongue having a rounded edge for displacing the latch tongue upon closing of the keeper structure to the latch structure, the keeper tongue being apertured inwardly of its the rounded edge to receive the latch tongue in latch assembly latching relation.

In a further embodiment, the invention provides a latch assembly comprising a keeper structure and opposed thereto a latch structure, the latch structure comprising a frame having a longitudinal frame axis, a semicylindrical frame recess in the frame generally parallel with the frame axis, a generally cylindrical guide pin partially received in the frame recess for oscillating rotation, the guide pin having a handle tab for rotating the guide pin in the frame recess and a latch dog projecting from the guide pin at generally a right angle to the handle tab, a latch tongue guide formed on the frame, a latch tongue slidably mounted in the latch tongue guide, the latch tongue having dog cooperating structure for advancing and retracting the latch tongue responsive to rotation of the dog on the guide pin, the guide pin being spring biased to project the latch tongue toward the latch structure, the dog cooperating structure and dog being relatively proportioned to permit rearward movement of the latch tongue without commensurately moving the handle tab upon displacing engagement of the keeper structure and the latch tongue but to move the handle tab and the latch tongue together free of lost motion in forward movement of the latch tongue into keeper structure latching engagement.

In this and like embodiments, typically, the frame comprises transverse bosses defining the latch tongue guide, the guide pin has terminal slots, and includes coiled biasing springs fixed to the guide pin and having tails kept in the slots for resiliently rotating the guide pin and dog, the housing cooperates with the frame to enclose the guide pin and dog, the latch tongue dog cooperating structure comprises an angled slot inward of the leading edge of the latch tongue, the slot having a front wall normal to the latch tongue plane of movement and a rear wall sloped away from the front wall in dog engagement differentiated relation for forward and rearward movement, the latch tongue leading edge being beveled toward the latch keeper, the keeper structure comprises a base to be fixed to a wall, and a keeper tongue, the keeper tongue having a rounded edge opposite the latch tongue leading edge for displacing the latch tongue upon closing of the keeper structure to the latch structure, the keeper tongue being apertured inwardly of its the rounded edge to receive the latch tongue in latch assembly latching relation.

In a further embodiment, the invention provides a latch assembly comprising a keeper structure and opposed thereto a latch structure, the latch structure comprising a latch frame and a handle frame attachable to the latch frame, the latch frame having a latch tongue for reciprocal movement in spring biased relation, the latch tongue having a latch dog at a generally right angle to the latch tongue, the latch frame having a latch handle biasing spring supported therein; the handle frame having a longitudinal frame axis and a guide pin having a handle attached for oscillating movement relative to the handle frame, a first guide pin dog carried by the guide pin for rotation therewith in engagement with the latch dog for shifting the latch tongue into the latch frame housing, a second guide pin dog engaging the latch handle biasing spring in the latch frame housing, the first and second guide pin dogs being angularly offset on the guide pin, the latch tongue being rearwardly deflectable by engagement with the keeper structure against the spring bias, the latch tongue dog and the first guide pin dog being relatively proportioned to permit rearward movement of the latch tongue without commensurately moving the handle upon displacing engagement of the keeper structure and the latch tongue but to move the handle tab and the latch tongue together in forward movement of the latch tongue into keeper structure latching engagement.

In this and like embodiments, typically, the latch tongue has a pair of latch dogs, the guide pin has a pair of first guide pin dogs for displacing contact with the pair latch tongue latch dogs against the latch tongue spring bias, the latch frame has a pair of latch handle biasing springs supported therein, and the guide pin has a pair of second guide pin dogs in registration with the a pair of latch handle biasing springs, and the latch assembly is a first latch assembly, and there is also included a second latch assembly mounted in the handle frame, the second latch assembly acting to lock the first latch assembly handle against movement in the latched condition of the first latch assembly.

BRIEF DESCRIPTION OF THE SEVERAL VIEWS OF THE DRAWINGS

The invention will be further described in conjunction with the attached drawings in which.

DETAILED DESCRIPTION OF THE INVENTION

Figure 1:
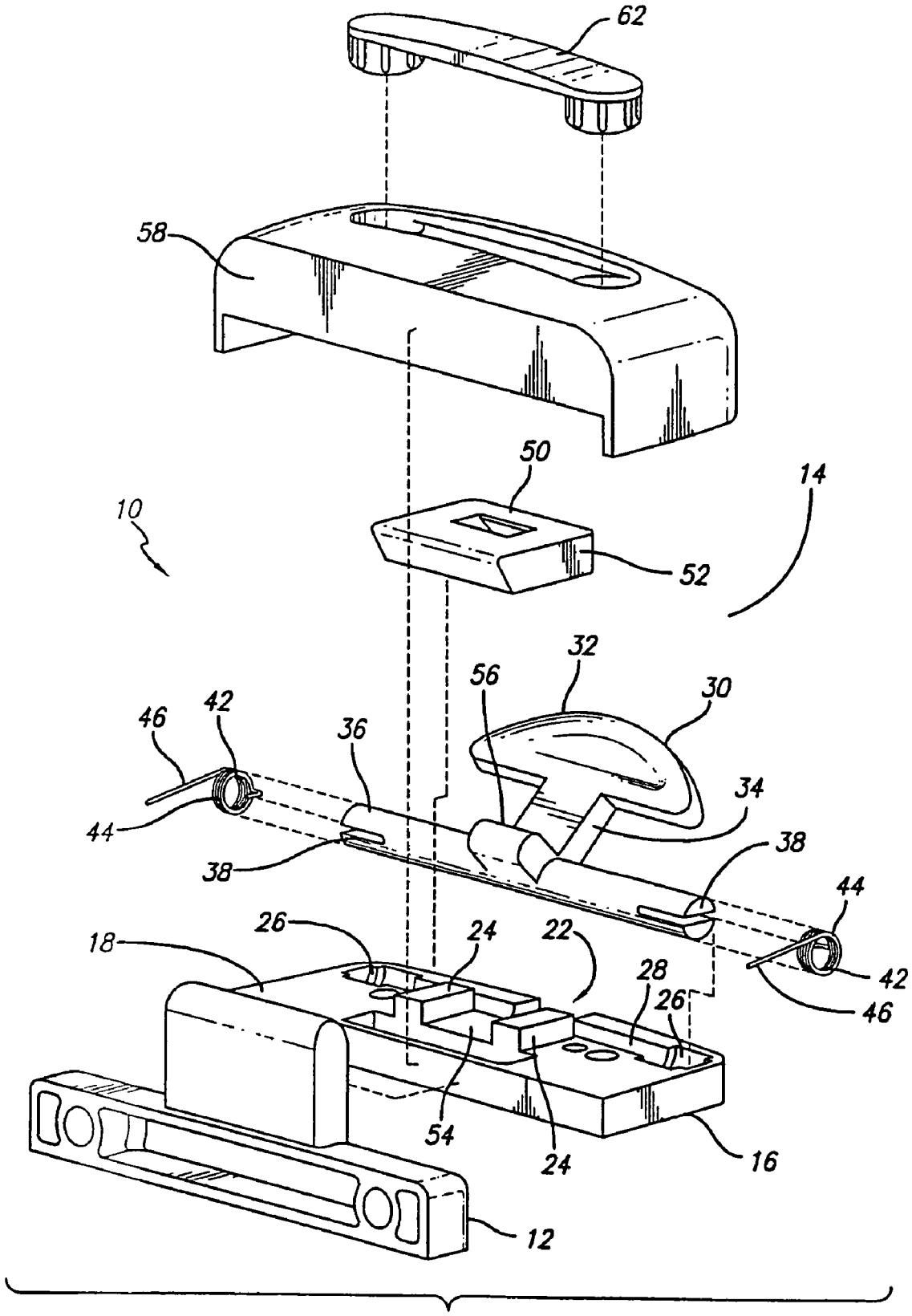
FIG. 1 is an exploded oblique view of the invention latch in a first embodiment.

With reference to the drawings in detail, in FIGS. 1-4 latch assembly 10 includes a keeper structure 12 and a latch structure 14. The keeper and latch structures 12, 14 are arranged to be mounted to a stationary component of a sliding closure (not shown) and the moving component (not shown) of the closure where the two components are in parallel planes, the keeper and latch structure projecting from their components to intersect in a common plane.

Latch structure 14 includes a frame 16 comprising a generally horizontally extending part 18 having a mounting region 22 with suitable bosses 24 and recesses 26, 28 arranged to receive and position the other latch structure parts to be described. Latch structure 14 further includes a latch handle actuator 30 having a finger tab 32 on support 34 mounted on guide pin 36. Guide pin 36 is cylindrical to fit with frame part recess 28; Pin 36 has slotted recesses 38 at opposite ends thereof. Torsion springs 42 include a coiled portion 44 and a tail 46; tails 46 is received in respective ones of slot recesses 38. The spring coiled portions are received in recesses 26 formed in the frame part 18 and to rotate clockwise the guide pin 36, received in recess 28, and thus rotate the actuator tab 32 away from keeper structure 12. Guide pin 36 has a dog 56 that is integral with the guide pin and located beyond the pin-receiving recess 28 and arranged to enter the latch tongue 52 at opening 50. Latch tongue 52 is slidably received in frame recess 54 where it is pierced by dog 56 for purposes of shifting outward or inward for latching engagement with the keeper 12. Under the force of torsion springs 42 the dog 56 forces the tongue 52 forward into the keeper 12. Upon pressing down on the actuator tab 32, the dog 56 moves rearwardly, such that the tongue retreats in the recess 54. As the tongue 52 and dog 56 are closely engaged movement of the tongue 52 (for example, when the tongue 52 contacts the keeper 12 upon closure of the window), in turn moves the dog 56, which causes movement of the actuator tab 32.

Housing 58 and cover 62 for covering the assembly screws (not shown) complete the latch assembly 10.

Figures 2, 3, 4:
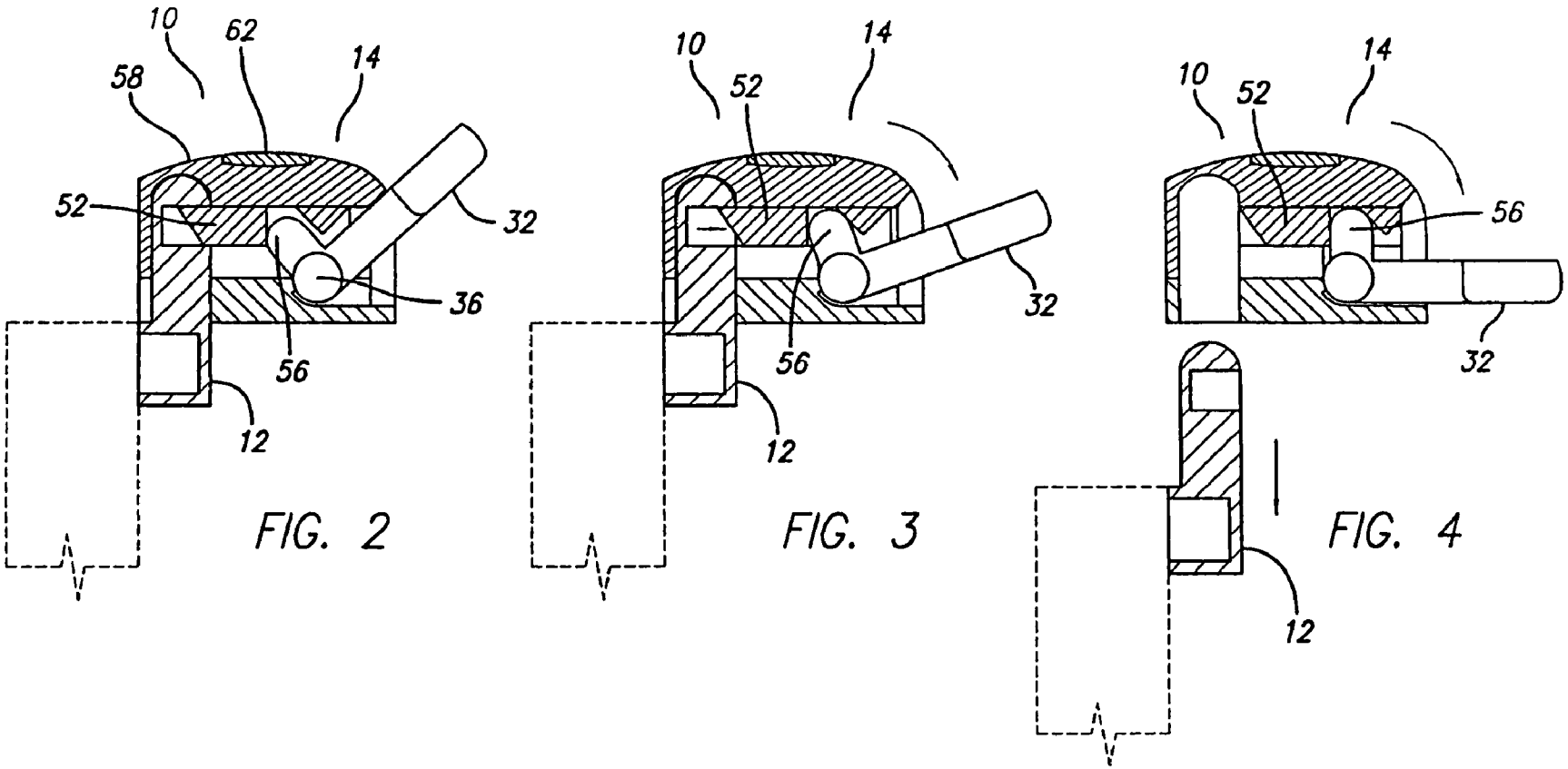
FIGS. 2, 3 and 4 are progressive detail views generally in horizontal section of the latch handle actuator, latch tongue and keeper in progress from a closed to an open condition.
Figure 5:
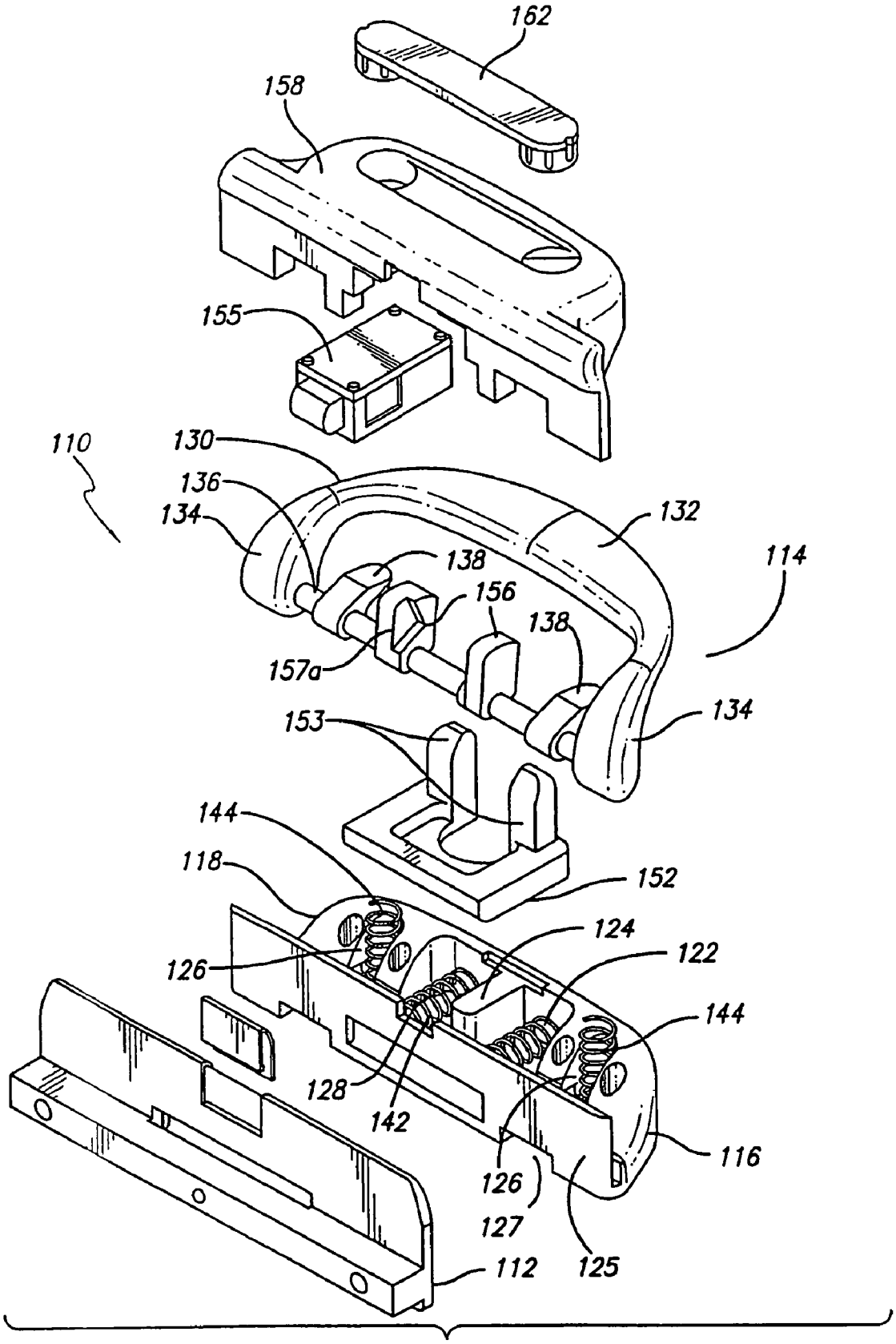
FIG. 5 is a view like FIG. 1 of a second embodiment.

Considering in reverse sequence FIGS. 2, 3 and 4, the unlocked condition is shown in FIG. 4 with the dog 56 in latch tongue opening 50. Entry of the keeper structure 12 into the latch structure 14 illustrated by comparing FIGS. 4 and 3, displaces tongue 52 rearwardly and thus moves the actuator handle finger tab 32. Comparing FIGS. 3 and 2, under the force of torsion springs 42, the handle actuator 30 rotates counterclockwise and urges the latch tongue 52 into keeper structure 12.

With reference now to FIGS. 5-9 latch assembly 110 includes a keeper structure 112 and a latch structure 114. The keeper and latch structures 112, 114 are arranged to be mounted to a stationary component of a sliding closure (not shown) and the moving component (not shown) of the closure where the two components are in parallel planes, the keeper and latch structure projecting from their components to intersect in a common plane.

Latch structure 114 includes a frame 116 comprising a generally horizontally extending part 118 having a mounting region 122 with suitable bosses 124 and recesses 126, 128 arranged to receive and position the other latch structure parts to be described. A face plate 125 of the frame 116 may include one or more recesses 127 for engagement with projections or hooks 129 on the keeper structure 112. Latch structure 114 further includes a latch handle actuator 130 having a finger pull 132 on supports 134 mounted on guide pin 136. Guide pin 136 is cylindrical to fit with frame part recess 128; Pin 136 has projecting lobes 138 intermediate its ends. Compression springs 144 are received in respective ones of recesses 126 formed in the frame part 118 and to rotate counterclockwise the guide pin 136, received in recess 128, and thus rotate the actuator finger pull 132 away from keeper structure 112. Guide pin 136 has dogs 156 that are integral with the guide pin and located beyond the pin-receiving recess 128 and arranged to engage the latch tongue 152 at posts 153. In certain embodiments, one or both dogs 156 may contain a notch 157*a*, for engaging a projecting pin 157 of an internal latch 155, as described below in FIGS. 10 and 11. Latch tongue 152 is disposed for reciprocal movement in recess 128. Recess 128 is oversized, relative to the volume of latch tongue 152 to permit the latch tongue to slide backward against one or more springs 142 when the closure panels (not shown) are brought together. Latch handle actuator 130 having rotated from engagement with the tongue 152 under the force of springs 142 moves the dogs 156 from the path of the displaced and inward moving latch tongue so that the tongue retreats in the recess 128 as the panels (not shown) are brought together. This retreat movement of the latch tongue 152 does not deflect the latch handle actuator pull 132 so that fingers holding onto the pull are not pinched against the opposing window frame (not shown) or latch structure 114. The dogs 156 nonetheless will immediately engage the latch tongue 152 when the latch handle actuator 130 is operated to open the latch 112 from its locked condition.

Housing 158 and cover 162 for covering the assembly screws (not shown) complete the latch assembly 110.

Figure 8:
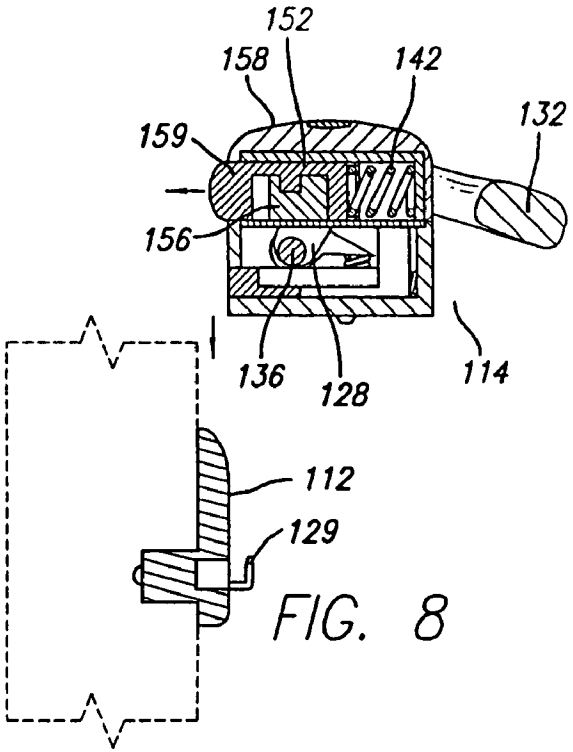
FIGS. 6, 7 and 8 are progressive detail views generally in horizontal section of the latch handle actuator, latch tongue, keeper and secondary internal lock in progress from a closed to an open condition.
Figure 7:
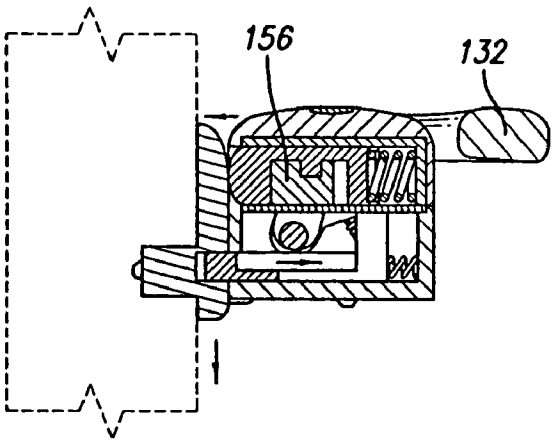
Figure 6:
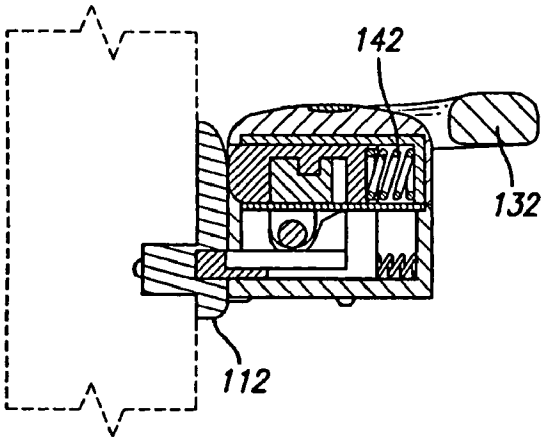

Considering in reverse sequence FIGS. 6, 7 and 8, the unlocked condition is shown in FIG. 8 with the dogs 156 engaging but not advancing the latch tongue 152. Entry of the keeper structure 112 into the latch structure 114 illustrated by comparing FIGS. 8 and 7, does not displace tongue 152 rearwardly or shift the actuator handle pull 132 so that finger pinching is avoided. Comparing FIGS. 7 and 6, under the force of springs 142, the actuator handle pull 132 rotates counterclockwise and urges the latch tongue 152 into keeper structure 12.

Figure 9:
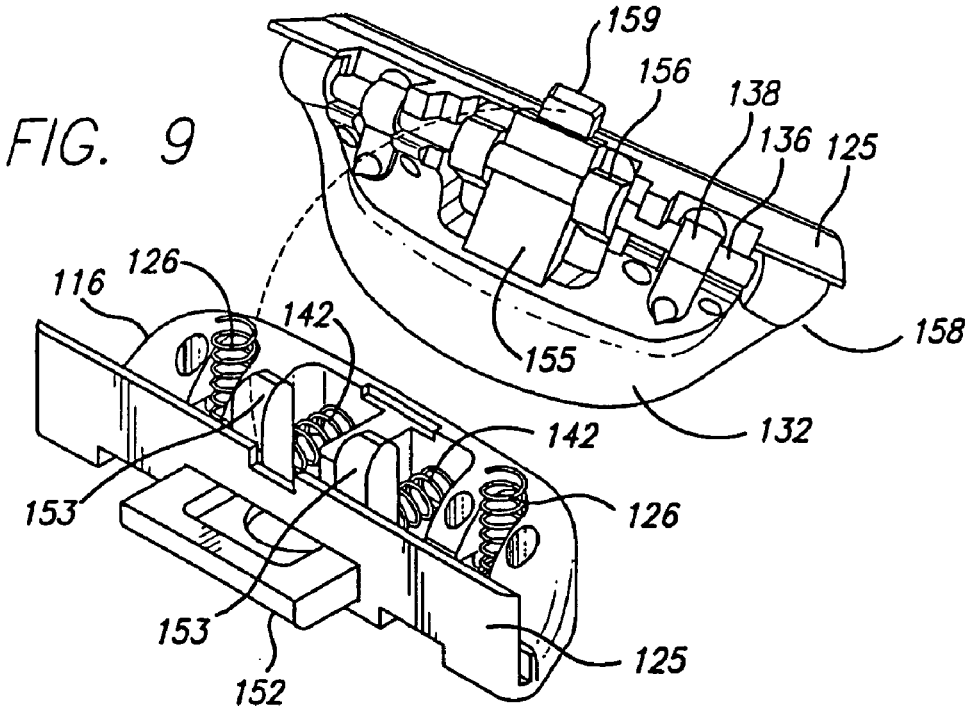
FIG. 9 is an exploded oblique view of the second embodiment latch assembly.
Figure 10:
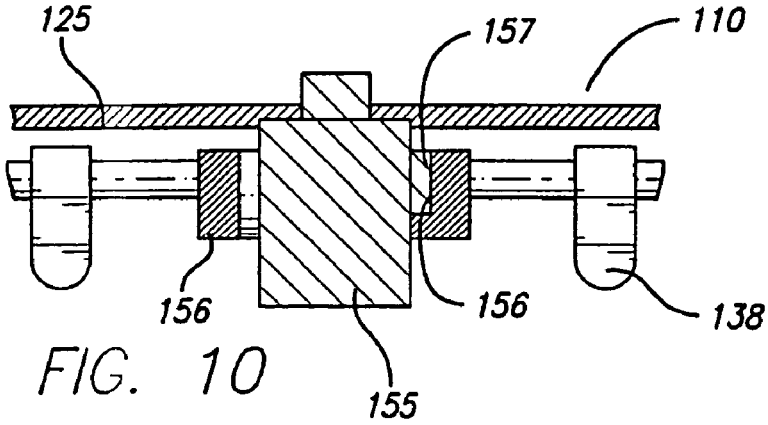
FIG. 10 is a sectional view of the secondary internal lock latch assembly in locked condition against the guide pin; and, FIG. 11 is a view like FIG. 10, with the secondary internal lock latch assembly in unlocked condition.
Figure 11:
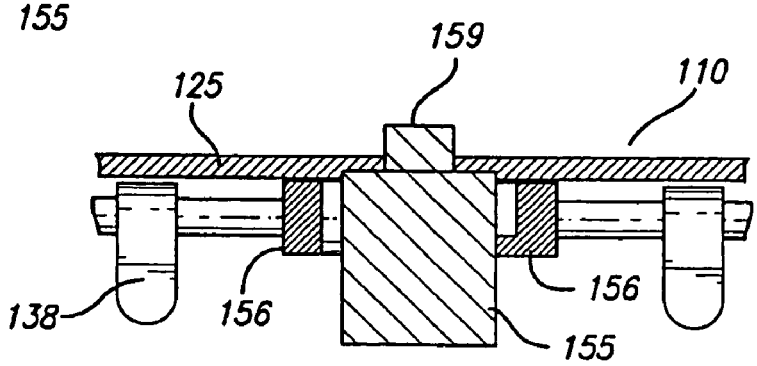

With reference to FIGS. 9, 10 and 11, the internal lock secondary latch assembly 155 serves to hold pull 132 close to latch frame 118 where clearances are a concern and with laterally projecting pin 157 serves to lock guide pin 136 from rotation by engaging the notch 157*a* on one of the dogs 156. As tab 159 contacts the keeper structure 112 (as depicted in FIG. 8), projecting pin 157 is released from engagement with the notch 157*a*, which releases pull 132 and projects tongue 152 into the keeper 112.

I claim:

1. A latch assembly for a sliding closure, the latch assembly comprising:

a keeper; and a substantially symmetrical latch in opposition to the keeper, the latch comprising:

a frame having a longitudinal frame axis;

a tongue slidably mounted relative to the frame, the tongue substantially near a midpoint of the frame;

a guide pin rotatably mounted relative to the frame, the guide pin substantially parallel with the axis;

at least one dog extending from the guide pin and engaged with the tongue;

a handle extending from the guide pin at an angle to the dog, the handle substantially near a midpoint of the frame, and wherein a movement of the handle causes a corresponding movement of the tongue; and means for biasing the handle, the biasing means being substantially symmetrically disposed about a midpoint of the frame, and wherein the biasing means rotates the guide pin such that the dog urges the tongue into the keeper.

2. The latch assembly of claim 1, wherein the at least one dog is substantially near a midpoint of the frame.

3. The latch assembly of claim 1, wherein the at least one dog comprises a first dog and a second dog, wherein the first dog and the second dog are substantially symmetrically located on opposite sides of the midpoint of the frame.

4. The latch assembly of claim 1, wherein the keeper is adapted to be installed on a first sash of a window frame, and wherein the latch is adapted to be installed on a second sash of a window frame, wherein the first sash and the second sash comprise substantially parallel first and second planes.

5. The latch assembly of claim 4, wherein the keeper and the tongue of the latch substantially intersect at a common plane.

6. The latch assembly of claim 1, wherein the keeper comprises at least one hook and wherein the frame defines at least one recess, wherein the hook is adapted to engage the recess.

7. The latch assembly of claim 1, further comprising at least one spring, wherein the spring biases the tongue toward the keeper.

8. The latch assembly of claim 7, wherein the at least one spring comprises a first spring and a second spring, wherein the first spring and a second spring are substantially symmetrically located on opposite sides of the midpoint of the frame.

9. The latch assembly of claim 8, further comprising at least one actuator spring, wherein the actuator spring biases the handle relative to the frame.

10. The latch assembly of claim 9, wherein the at least one actuator spring comprises a first actuator spring and a second actuator spring, wherein the first actuator spring and a second actuator spring are substantially symmetrically located on opposite sides of the midpoint of the frame.

11. The latch assembly of claim 9 further comprising at least one lobe projecting from the guide pin at an angle from the at least one dog, the lobe contacting the at least one actuator spring.

12. A latch assembly for a sliding closure, the latch assembly comprising:

a keeper; and a substantially symmetrical latch in opposition to the keeper, the latch comprising:

a frame having a longitudinal frame axis;

a tongue slidably mounted relative to the frame, the tongue substantially near a midpoint of the frame;

a guide pin rotatably mounted relative to the frame, the guide pin substantially parallel with the axis;

two dogs extending from the guide pin and engaged with the tongue;

a handle extending from the guide pin at an angle to the dogs, the handle substantially near a midpoint of the frame, and wherein a movement of the handle causes a corresponding movement of the tongue; and means for biasing the handle, the biasing means being substantially symmetrically disposed about a midpoint of the frame; and wherein the tongue further comprises two dog cooperating structures for contact with the dogs, the dog cooperating structures and the dogs being configured to permit rearward movement of the tongue without commensurately moving the handle.

13. The latch assembly of claim 12, wherein the keeper comprises at least one hook and wherein the frame defines at least one recess, wherein the hook is adapted to engage the recess.

14. The latch assembly of claim 12 further comprising an internal latch, wherein the internal latch is configured to lock the guide pin from rotation.

15. The latch of claim 14, wherein the tongue is configured to be in a retracted position when the guide pin is locked.

16. The latch assembly of claim 15, wherein the internal latch comprises:

a projecting pin configured to engage at least a portion of at least one dog; and a tab configured to retract the projecting pin upon contact between the tab and the keeper.

17. The latch assembly of claim 16, wherein the portion of the at least one dog comprises at least one notch.

18. The latch assembly of claim 14, wherein the keeper comprises at least one hook and wherein the frame comprises at least one recess, wherein the hook is adapted to engage the recess.

* * * * *